United States Patent [19]

Murata

[11] Patent Number: 4,531,032

[45] Date of Patent: Jul. 23, 1985

[54] LOCKING TYPE PUSHBUTTON SWITCH

[75] Inventor: Taneo Murata, Iwaki, Japan

[73] Assignee: Alps Electric Co., Ltd., Japan

[21] Appl. No.: 558,325

[22] Filed: Dec. 5, 1983

[30] Foreign Application Priority Data

Dec. 3, 1982 [JP] Japan ..... 57-182484[U]
Dec. 3, 1982 [JP] Japan ..... 57-182485[U]

[51] Int. Cl.[3] ..... H01H 13/56
[52] U.S. Cl. ..... 200/153 J
[58] Field of Search ..... 200/153 J, 328

[56] References Cited

U.S. PATENT DOCUMENTS

| | | | |
|---|---|---|---|
| B 376,504 | 1/1975 | Lockard | 200/153 J |
| 4,160,143 | 7/1979 | Schlesier et al. | 200/153 J |
| 4,249,053 | 2/1981 | Tsutsui | 200/153 J |
| 4,368,368 | 1/1983 | Russenberger | 200/153 J |

FOREIGN PATENT DOCUMENTS

| | | | |
|---|---|---|---|
| 2816185 | 10/1979 | Fed. Rep. of Germany | 200/153 J |
| 2816869 | 10/1979 | Fed. Rep. of Germany | 200/153 J |
| 6610818 | 2/1967 | Netherlands | 200/153 J |

*Primary Examiner*—John W. Shepperd
*Attorney, Agent, or Firm*—Guy W. Shoup

[57] ABSTRACT

A locking type pushbutton switch has a lock pin comprised of a pin part and mounting part. The mounting part may move towards and away from the stem of the pushbutton device and may rotate in a plane parallel therewith. The mounting part is further provided with a spherical surface which is held resiliently in contact with a supporting wall found on the case, and the pin is also held resiliently in contact with the heart-shaped cam groove by the spring.

4 Claims, 7 Drawing Figures

LOCKING TYPE PUSHBUTTON SWITCH

FIELD OF THE INVENTION

This invention relates to a locking type pushbutton switch which closes movable contacts by locking a pushbutton through depressing operations of the pushbutton.

BACKGROUND OF THE INVENTION

A locking type pushbutton switch of this kind is represented in FIG. 1. In FIG. 1, an upper case 1 has an open lower end closed by a lower case 2, and a stem 3 is provided to move vertically through the upper wall 1*a* of the upper case 1. At the upper end of this stem 3, a pushbutton not shown is mounted. A spring 4 is provided between the stem 3 and the upper surface of upper case 1 so as to urge the stem 3 upwardly.

On opposite surfaces of the inner wall of upper case 1, grooves 1*b* and 1*b* are formed as shown in FIG. 2. A fixed plate 5 shown in FIG. 3 is inserted into the grooves 1*b* and 1*b* of the upper case 1 and fixed therein by attaching the lower case 2 to the upper case 1. A hole 6 is bored at the center of this fixed plate 5 and the one end 7*a* of a C-shaped lock pin 7 is engaged within this hole 6. The other end 7*b* of this lock pin 7 is inserted into a heart-shaped cam groove 8 of the stem 3 and is held in resilient contact with the bottom part of the heart-shaped cam groove 8 by a plate spring 9 provided between the lock pin 7 and the inner wall of upper case 1.

Moreover, the lower case 2 is provided with the terminals 10 and 11 projected downwards. Terminal 10 is integrally provided with a fixed contact 10*a* having a projection 10*b*, while the terminal 11 is provided with a movable contact 11*a*. Moreover, the fixed contact 10*a* is held within a fixed resin frame 12. This frame 12 is integrally provided with the flexible tongue piece 12*a*, and a fixed plate spring 14 is fitted over the top portion of the frame 12 to press the flexible piece 12*a* rightwardly in FIG. 1 when the stem 3 is depressed into the case 1.

In such a locking type pushbutton switch, when the pushbutton (not shown) is depressed downward, causing the stem 3 to move downwardly in opposition to the spring force of the spring 4, the plate spring 14 and flexible piece 12*a* are bent to the right in FIG. 1 and the movable contact 11*a* is placed in contact with the projection part 10*b* of the fixed contact 10*a*. Moreover, at this time, the end 7*b* of lock pin 7 slidingly moves within the heart-shaped cam groove 8 of the stem 3. After the movable contact 11*a* is in contact with the projection part 10*b*, namely when the movable contact 11*a* closes, the stem 3 is locked by the lock pin 7 and heart-shaped cam groove 8 so the stem cannot move upwards. When the pushbutton is further depressed from such a condition and is then released, the locking engagement of the lock pin in the cam groove is released and the stem 3 is returned to the initial state by a spring force of the spring 4, and the movable contact 11*a* opens. Under this condition, a stepped part (not shown) of the stem 3 is in contact with the upper wall of the upper case 1 and thereby the stem 3 is prevented from moving further upwards as a result of the spring force of the spring 4.

A locking type pushbutton switch having such structure is required to have a simple structure with less number of parts, to be more tolerant of dimensional errors and assure easy manufacturing and long operating life.

SUMMARY OF THE INVENTION

It is an object of this invention to provide a locking type pushbutton switch meeting such requirements of existing locking type pushbutton switch.

In order to attain this object, the locking pin of a locking type pushbutton switch of this invention has a pin part having an end point held in contact with the heart-shaped cam groove and a mounting part integrated to the pin part. The mounting part is held for movement towards and away from the stem and may also rotate within a plane parallel to movement of the stem. The mounting part, however, may not move in the axial direction of the stem. A spheric surface is provided in the stem side of the mounting part, and a supporting wall is provided on the case to face the spherical surface. The spherical surface is held resiliently in contact with the supporting wall with a spring provided between the case and the mounting part, and simultaneously the pin part is held resiliently in contact with the heart-shaped cam groove by the spring, thereby the structure is simplified with less number of parts, and severe dimensional accuracy is not required, moreover manufacturing is not so difficult and a long operating life is assured.

DETAILED DESCRIPTION OF THE INVENTION

Figure 1:
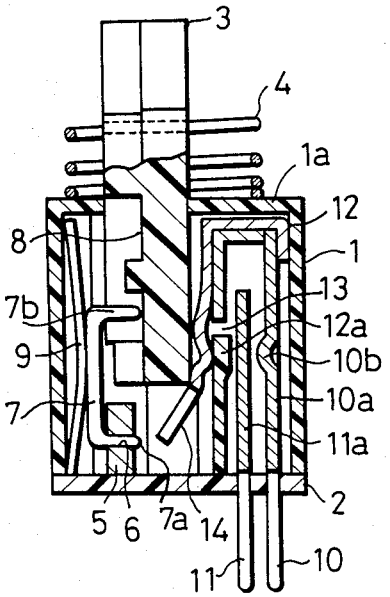
Fig.1 PRIOR ART
FIG. 1 is a cross-sectional view of an existing locking type pushbutton switch.
Figure 2:
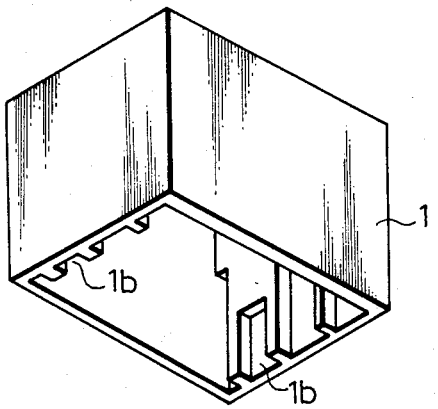
Fig.2 PRIOR ART
FIG. 2 is a perspective view of the upper case shown in FIG. 1.
Figure 3:
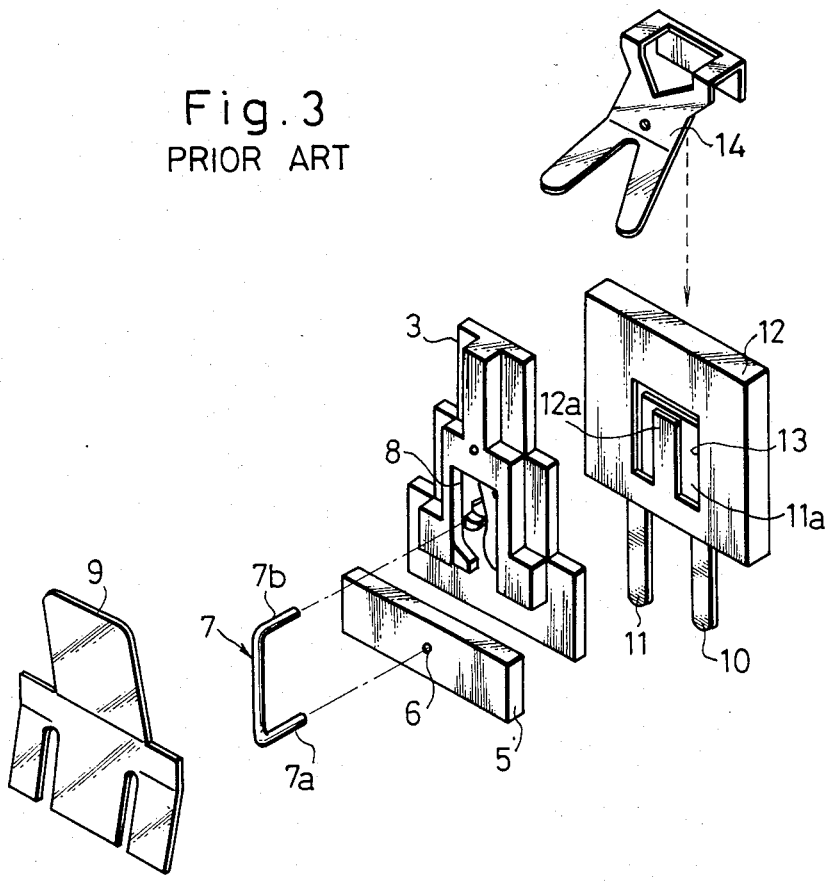
Fig. 3 PRIOR ART
FIG. 3 is a perspective view of essential parts of the switch of FIG. 1.

This invention will be described in detail by way of the preferred embodiment thereof with reference to FIG. 4 through FIG. 7. The elements that are the same as those in FIG. 1 through FIG. 3 are given the same reference numbers, and these are not described further herein.

In FIG. 4 through FIG. 7, upper and lower portions of one side wall of the upper case 1 have openings 15 and 16 defined therein and separated by the crosspiece 17 having an indent 17*a*. The lower case 2 has upstanding side walls 2*a* fitting over the lower portions of the upper case 1, and a supporting wall 18 extends upwardly in the vicinity of the portions of the side wall 2*a* adjacent the opening 16. This supporting wall 18 is provided in parallel with the side wall 2*a* and its height is almost equal to the crosspiece 17.

The stem 3 inserted into the upper case 1 has a hole 19 formed in its lower end, and a projection 20 is provided in this hole to face a projection 21 provided in the bottom wall of the lower case 2. Thus, a spring 22 is provided between this stem 3 and the lower case 2 in such a manner so as to engage the projections 20 and 21.

A unitary lock pin 23 is formed by a generally L-shaped pin part 25 and a mounting part 24. The lock pin 23 may, for example, be formed of a polycarbonate having high anti-creep characteristic. The lock pin 23 may, however, be formed from a material other than a polycarbonate having high anti-creep characteristic. The mounting part 24 is provided with a circular part 26 having a spherical surface 27 and thin ear parts 28 and projecting from mutually opposing sides of the circumference of the circular part 26.

The circular part 26 of this lock pin 23 is adapted to be fitted within the window 16, and the crosspiece 17 and the lower case 2 serve to hold the circular part against movement with direction parallel to the stem 3. The pin part 25 is disposed in the indent 17*a* and the spherical surface 27 is resiliently held in contact with the supporting wall 18 by means of a curved plate spring 29 provided between the mounting part 24 and side wall 2*a*. This plate spring 29 urged the bend part 25*a* of the pin part 25 resiliently into contact with the heart-shaped cam groove 8. The pin part 25 can also be formed from a rigid material, for example, a metal rod.

Figure 4:
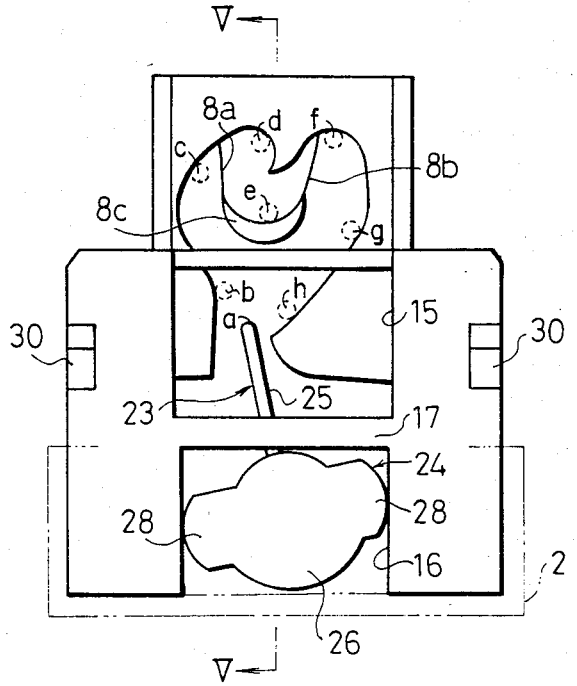
FIG. 4 is a front view of a locking type pushbutton switch of this invention.
Figure 5:
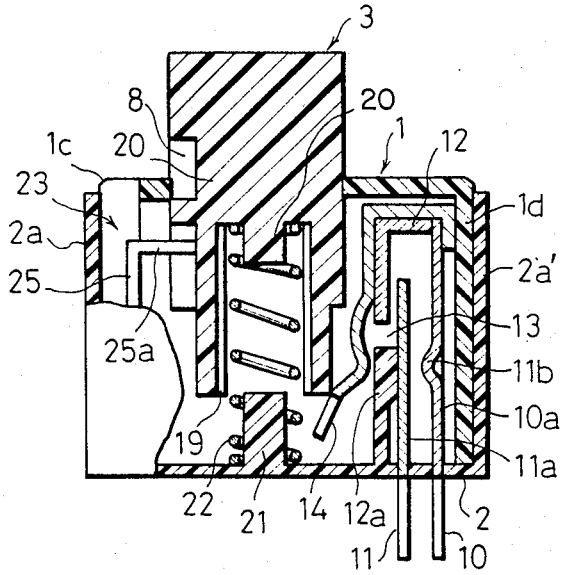
FIG. 5 is a cross-sectional view along the line V—V of FIG. 4.

As shown in FIG. 4, an engaging projection 30 is provided at the side wall 1*c* of the upper case 1 and an identical engaging projection is also provided at the side wall 1*d*. The cases 1 and 2 can be coupled by engaging there engaging projection 30 with corresponding recesses 31 provided in the side of the side walls 2*a*, 2*a'* of the lower case 2.

Operation of the locking type pushbutton switch having such structure is described below.

When the stem 3 is displaced downwardly in opposition to the spring 22 by depressing the pushbutton (not shown), the end point of the bent part 25*a* moves in the heart-shaped cam groove 8 of FIG. 4 from the position (a) to positions (b), (c) and then reaches the position (d) riding over the step 8*a*. When the pushbutton is released at this position, the stem 3 is displaced upward by the force of spring 22 and thereby the bent part 25*a* is stopped at the position (e) by engaging with the crescent-shaped projection 8*b* of the cam groove 8. Thereby, the stem 3 is locked so that it no longer can be displaced upwards. In this condition, the movable contact 11*a* is placed in contact with the projection 10*b* of the fixed contact 10*a*. Namely, the movable contact 11*a* is closed.

When the pushbutton is further depressed from this condition and the stem 3 is thereby displaced downwards, the bent part 25*a* starts to move from the position (e) and then reaches the position (f) after riding over the step part 8*c*. When the pushbutton is released in this condition, the stem 3 is displaced upward by the force of spring 22 and the bent part 25*a* passes the positions (g), (h) and returns to the original position (a). At this position, the movable contact 11*a* is open.

Figure 6:
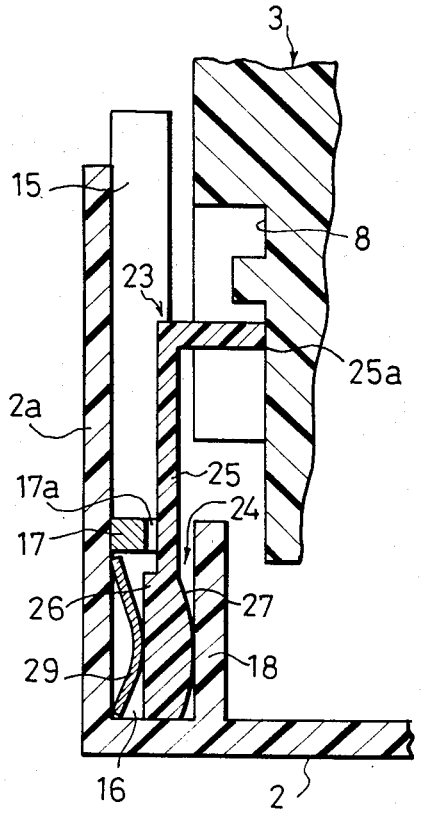
FIG. 6 is an enlarged cross-sectional view of major portions of the switch of this invention.
Figure 7:
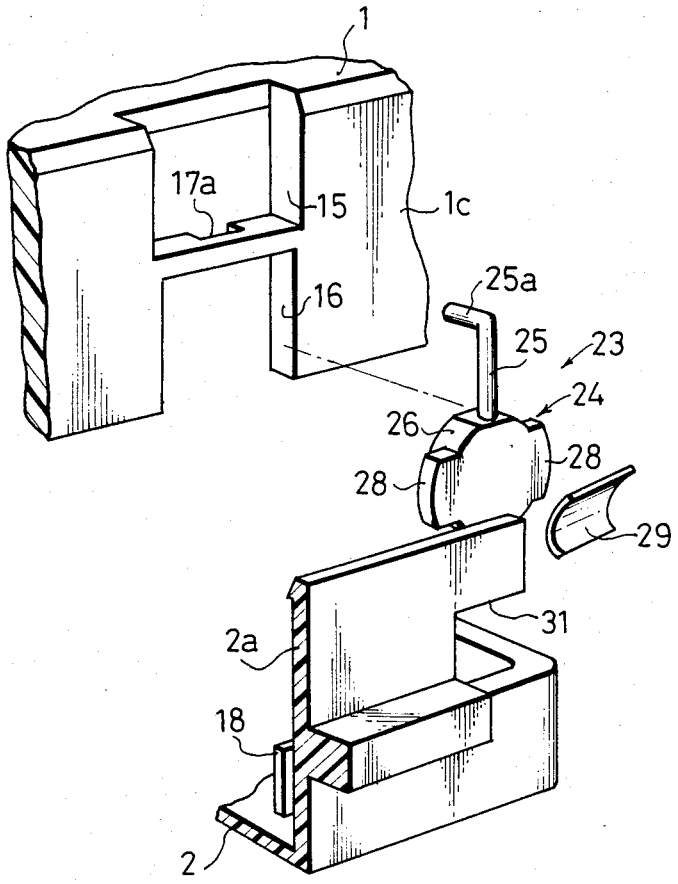
FIG. 7 is a perspective view of major parts of a switch of this invention.

According to such operation, the lock pin 23 rotates around the circular part 26, the pin part 25 moves to the right and left within the indent 17*a*, and simultaneously, the pin part 25 is flexed to the right and left as shown in FIG. 6 by the heart-shaped cam groove 8.

As described above, this invention provides a locking type pushbutton switch wherein the lock pin is comprised of the pin part having an end point held in contact with the heart-shaped cam groove, and the mounting part is integrated to the pin part. The mounting part is held so that it may move towards or away from the stem and may also rotate within a plane parallel to the movement of the stem, but cannot move in the axial direction of the stem. A spheric surface is provided on the side of the mounting part adjacent the stem, and a supporting wall is provided in the case to face this facing spherical surface. The spherical surface is held resiliently in contact with the supporting wall with a spring provided between the case and the mounting part, and simultaneously the pin part is resiliently held in contact with the heart-shaped cam groove, thereby the structure is simplified with less number of parts, and severe dimensional accuracy is not required. Accordingly, such switch body can be manufactured easily and moreover a long operating life can be ensured by forming the pin part from a rigid material.

What is claimed is:

1. A locking type pushbutton switch having a stem movable axially within a case for activating a switch mechanism therein, and means including a heart-shaped cam groove formed on a side of said stem and a lock pin held resiliently into engagement with said cam groove for holding said stem in a locked position activating said switch mechanism, said lock pin being a unitary structure including a mounting part and a pin part, said mounting part having a spherical surface facing said stem and adapted to engage a supporting wall held to a casing for said switch, and a spring urging said spherical surface against said supporting wall whereby said locking pin may move towards or away from said stem to hold said pin part resiliently within said cam groove while being able to rotate in a plane parallel to the path for movement of said stem.

2. A locking type pushbutton switch according to claim 1, said mounting part being fitted within a recess formed in a side wall of said casing and having lateral ear portions adapted to ride on wall portions of said recess.

3. A locking type pushbutton switch according to claim 1, wherein said lock pin is formed from a synthetic material having a high anti-creep characteristic.

4. A locking type pushbutton switch according to claim 1, said pin part being formed of a rigid material.

* * * * *